US005375849A

United States Patent [19]

Sabourin

[11] Patent Number: 5,375,849

[45] Date of Patent: Dec. 27, 1994

[54] SWIMMING POOL GAME

[76] Inventor: Guy Sabourin, 63 Bella Vista, St. Basile-le-Grand, Quebec, Canada, J3N 1L1

[21] Appl. No.: 169,990

[22] Filed: Dec. 16, 1993

[30] Foreign Application Priority Data

Jul. 2, 1993 [CA] Canada ..... 2099527

[51] Int. Cl.[5] ..... A63B 67/00

[52] U.S. Cl. ..... 273/411

[58] Field of Search ..... 273/411, 26 EA, 58 C

[56] References Cited

U.S. PATENT DOCUMENTS

| | | | |
|---|---|---|---|
| 3,582,078 | 6/1971 | Katras et al. | 273/411 X |
| 3,924,855 | 12/1975 | Pretorius | 273/26 EA X |
| 4,307,887 | 12/1981 | Weiss | 273/411 |
| 4,523,762 | 6/1985 | Garner, Sr. | 273/411 |
| 4,576,379 | 3/1986 | Juhasz | 273/58 C X |

*Primary Examiner*—William H. Grieb

*Attorney, Agent, or Firm*—Eric Fincham

[57] ABSTRACT

There is provided equipment for a game adapted to be played in an above ground pool. The game resembles the game of volleyball and includes a tethered ball which is secured by its tether to a cable stretching across the pool; the tether is free to slide along the cable.

2 Claims, 2 Drawing Sheets

SWIMMING POOL GAME

BACKGROUND OF THE INVENTION

The present invention relates to an amusement device, and more particularly, relates to a game adapted to be played in an above ground pool.

Due to their relative cheapness, above ground swimming pools are now widely available and used. However, due to their limited depth, a number of activities which might normally be enjoyed in larger swimming pools and in-ground swimming pools are not suitable. Thus, for example, these pools are generally not suitable for diving or extensive swimming. Accordingly, the use obtained from such above ground pools may be minimal.

SUMMARY OF THE INVENTION

It is an object of the present invention to provide an amusement device which may be used with above ground pools. This amusement device takes the form of a game which is adapted from the game of volleyball.

According to the invention, there is provided an amusement device for use with an above ground swimming pool, the device comprising first and second support members which extend vertically upwardly proximate opposed sides of the pool, a cable extending transversely across the pool between the support members, and a tethered ball having a free end of the tether secured to the cable such that the free end of the tether is capable of sliding longitudinally along the cable.

In greater detail, the invention is adapted to be used in a form of a game which resembles the traditional game of volleyball wherein there are two teams, one on each side of the net, with the object being to hit the ball over the net and to not let the ball touch the water. Once the ball touches the water, a point is won.

The equivalent to a net used in volleyball, according to the present invention, is a cable which extends transversely across the pool. The cable member is attached to a pair of support members adjacent the sides of the pool. The support members may be designed to be held in place by any number of suitable means. Thus, for example, the support members may be driven into the ground or alternatively, a weighted base member may be utilized into which the support members are placed. Alternatively, the support members may be attached to the side of the pool. The particular type of arrangement can vary depending upon the pool, its rigidity and strength. For example, in some instances the pool walls do not provide a suitable place and/or strength for anchoring of the support members and in such a case, one of the other alternatives may be utilized.

The cable extending between the support members is designed to be a certain height above the water surface and preferably, this height would vary between and although this can, of course, be varied. The cable may be constructed of many different materials and could, for example, merely consist of a metal cable extending between the two support members with suitable means for attachment thereto. Such a cable would, however, have somewhat of a disadvantage in respect of the thermal expansion contraction which would result in a varying tension. If desired, adjustment means could be provided. Alternatively, other types of cables may be employed and one preferred embodiment utilizes an elasticized cable providing a certain amount of stretch within the cable. Such cables are well known in the art and readily available.

If desired, a net may also be provided to extend downwardly below the cable. However, in general terms, a net is not required and the net could not be attached to the cable as this will not permit proper functioning of the same as will be discussed hereinbelow.

A tethered ball is utilized in the game and such balls are readily available. Normally, these balls are substantially conventional balls, but with a point of attachment comprising a portion molded into the ball and which portion has a reinforced base area with an eye formed in an outwardly extending flange. These balls have, for example, been used in games like tether ball.

The free end of the tether is designed to be secured to the cable in a manner such that the tether is freely moveable longitudinally along the cable. To this end, many suitable arrangements can be employed. For example, the free end of the tether could be formed in a knot which is slidable along the cable or alternatively, a separate attachment member may be utilized to secure the tether to the cable.

Having thus generally described the invention, reference will be made to the accompanying drawings illustrating an embodiment thereof, in which:

DETAILED DESCRIPTION OF THE INVENTION

Figure 1:
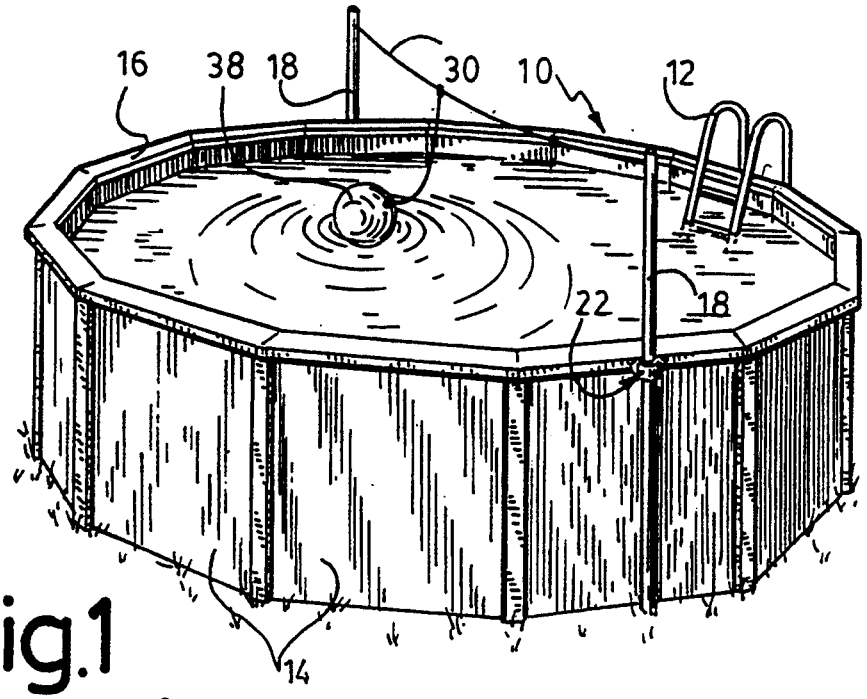
FIG. 1 is a perspective view of an above ground swimming pool utilizing the present invention.
Figure 2:
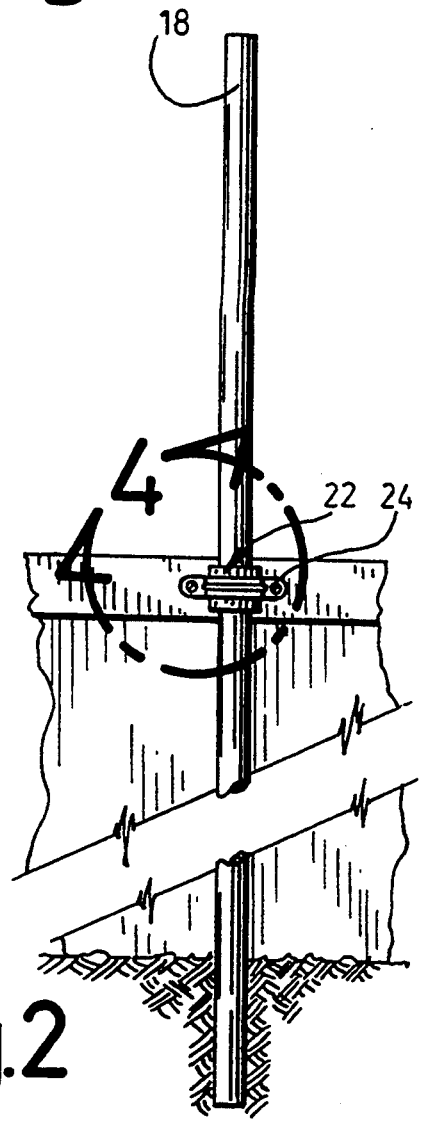
FIG. 2 is an end elevational view showing one of the support posts.
Figure 3:
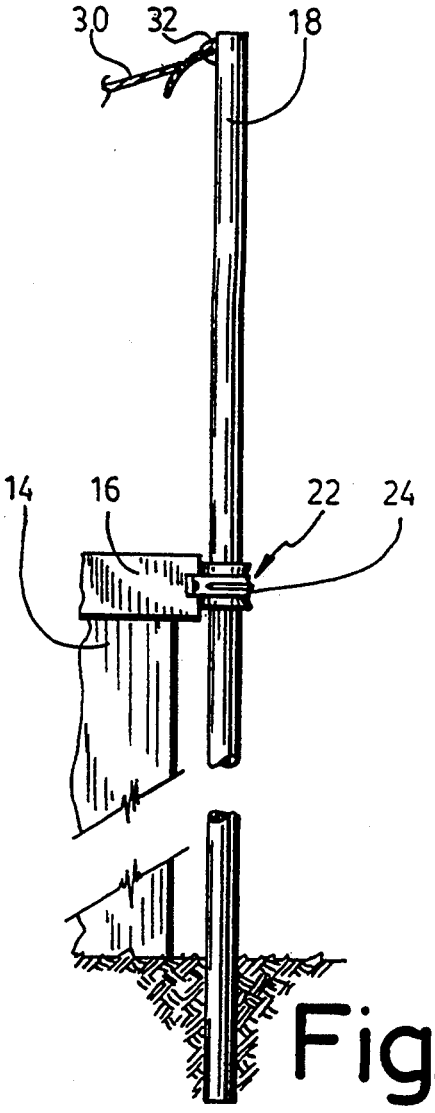
FIG. 3 is a side elevational view of the support post of FIG. 2.

In greater detail, and referring to the drawings by reference characters thereto, there is illustrated in FIG. 1 an above the ground swimming pool 10 having ladder 12 for gaining access thereto. Pool 10 is formed of a plurality of side panels 14 which are partially secured together by an upper frame 16. The above is a substantially conventional arrangement for above ground pools.

Figure 4:
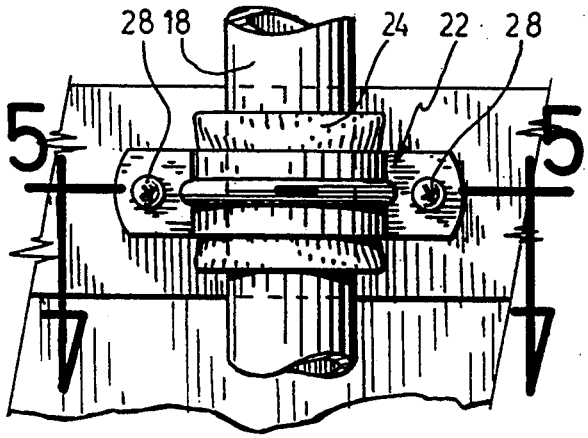
FIG. 4 is a detailed view of the portion indicated by arrow 4 of FIG. 2.
Figure 5:
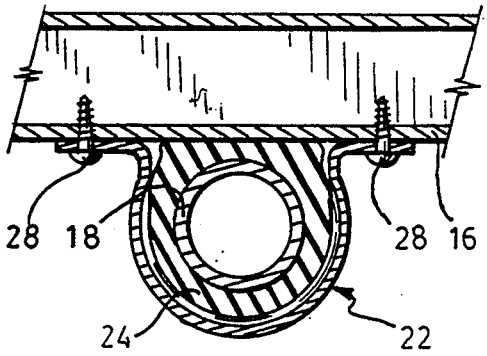
FIG. 5 is a sectional view taken along the lines 5—5 of FIG. 4.

The game apparatus includes a pair of upwardly extending posts 18 which are inserted into the ground for support and which are secured to upper frame 16. Thus, as may be seen in FIGS. 4 and 5, a C-shaped bracket member 22 is secured to upper frame 16 by means of screws 28. An insert 24 of a suitable resilient material such as high density foam is provided.

Figure 6:
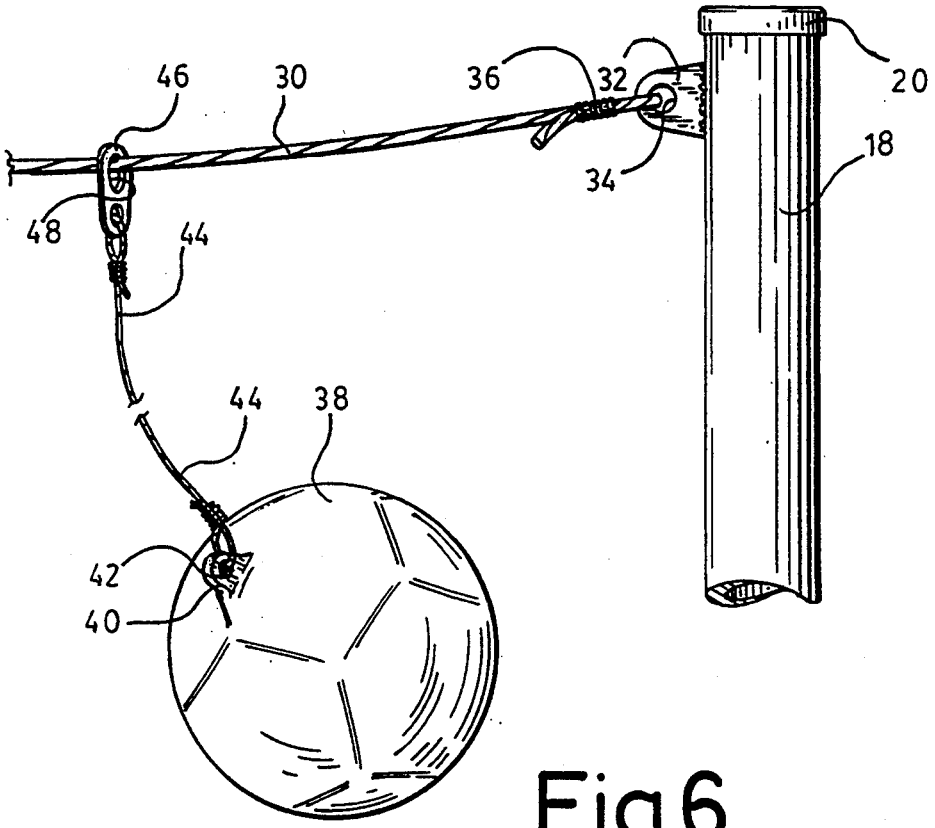
FIG. 6 is an expanded view of the ball and posts arrangement.

Support members or posts 18 have a cap 20 at the upper extremities thereof; also close to the upper extremity is a flange 32 having an aperture 34 formed therein. A cable 30 extends between post 18; preferably, the cable is kept relatively taught and is secured to the post, as indicated in FIG. 6, through aperture 34 of flange 32 and the rope is bound as indicated by reference numeral 36. Naturally, other attachment methods may be employed.

A ball 38 forms a portion of the game; ball 38 has an outwardly extending flange 40 with an aperture 42 formed therein. A tether 44 passes through aperture 42 and is suitably bound by conventional means. The other end of tether 44 is secured to a slider 46 which has an aperture 48 therein. Slider 48 is adapted to permit free movement along cable 30 and to this end, aperture 48 is sized to permit easy movement therealong. Naturally, a more complicated mechanical arrangement to permit movement therealong may be employed.

In operation, the game is played similar to the game of volleyball on land. The cables and ropes are sized to prevent the ball from escaping the pool area. While the dimensions may vary, typically, cable 30 will extend approximately 32 inches above the height of the pool. Cable 30, when it is of the elasticized variety, is preferably slightly less in dimension than the diameter or width of the pool so that there is a certain tension maintained in the cable. For example, typically a commercial elasticized cable would be approximately 6 feet less than the diameter of the pool. The elasticized cable permits a certain rigidity which is necessary to permit movement of the tether therealong while also permitting a certain limited flexibility which is desirable.

Tether 44 may be sized according to the pool and in preferred embodiments, it would be approximately 3 feet less than the radius of the pool although, this may be varied depending upon the age and skill of the players.

It will be understood that the above described embodiment is for purposes of illustration only and that changes and modifications may be made thereto without departing from the spirit and scope of the invention.

What is claimed is:

1. An amusement device for use with an above ground swimming pool comprising first and second support members extending vertically upwardly on both sides of the pool, an elasticized cable extending transversely across the pool having a first end thereof secured to said first support member and a second end secured to said second support member, and a tethered ball having a free end of said tether secured to said elasticized cable such that said tether is capable of moving longitudinally along said cable, said elasticized cable being, when in a relaxed non-attached state, has a length substantially shorter than the distance between said support members, and, when in a state of tension when secured to said support members, said elasticized cable is substantially rigid while permitting a limited flexibility when a force is exerted thereon by said tether.

2. The device of claim 1 wherein said cable is secured to said support member proximate an upper end thereof.

* * * * *